US010953963B2

(12) United States Patent
Syvertsen et al.

(10) Patent No.: US 10,953,963 B2
(45) Date of Patent: Mar. 23, 2021

(54) OFFSHORE VESSEL FOR PRODUCTION AND STORAGE OF HYDROCARBON PRODUCTS

(71) Applicant: Cefront Technology AS, Arendal (NO)

(72) Inventors: Kare Syvertsen, Tveit (NO); Jan Vidar Aarsnes, Hovag (NO); Ragnar Thunes, Faervik (NO)

(73) Assignee: Cefront Technology AS, Arendal (NO)

( * ) Notice: Subject to any disclaimer, the term of this patent is extended or adjusted under 35 U.S.C. 154(b) by 0 days.

(21) Appl. No.: 16/628,268

(22) PCT Filed: Jul. 10, 2017

(86) PCT No.: PCT/EP2017/067271
§ 371 (c)(1),
(2) Date: Jan. 3, 2020

(87) PCT Pub. No.: WO2019/011407
PCT Pub. Date: Jan. 17, 2019

(65) Prior Publication Data

US 2020/0216150 A1 Jul. 9, 2020

(51) Int. Cl.
*B63B 35/44* (2006.01)
*B63B 39/06* (2006.01)

(52) U.S. Cl.
CPC ..... *B63B 35/4413* (2013.01); *B63B 39/06* (2013.01); *B63B 2035/448* (2013.01); *B63B 2039/067* (2013.01)

(58) Field of Classification Search
CPC ..... B63B 35/4413; B63B 2035/448; B63B 39/06; B63B 2039/067
See application file for complete search history.

(56) References Cited

U.S. PATENT DOCUMENTS 3,491,711 A * 1/1970 Demo ..... B63B 5/16 114/65 R
3,978,605 A 9/1976 Maruniak
(Continued)

FOREIGN PATENT DOCUMENTS

WO WO2015/038003 3/2015
WO WO-2015038003 A1 * 3/2015 ..... B63B 1/041
(Continued)

*Primary Examiner* — S. Joseph Morano
*Assistant Examiner* — Jovon E Hayes
(74) *Attorney, Agent, or Firm* — Christian D. Abel

(57) ABSTRACT

The present invention relates to a spread moored vessel for production and/or storing of hydrocarbons. The vessel comprises a laterally extending main deck, a symmetrical mooring arrangement for mooring the vessel to a seabed when the vessel is floating in a body of water and a longitudinal hull. The longitudinal hull further comprises a bow, a midbody, a stern, and a motion suppressing element protruding out from the longitudinal hull, below the vessel's maximum draught. The ratio between a maximum length ($L_{wl}$) and a maximum breadth ($B_{wl}$) of the longitudinal hull, at the vessel's maximum draught, is between 1.1 and 1.5. The specific hull shape with the particular length/breadth ratio and the motion suppressing element allows for favorable and uniform motions regarding of wave direction in relation to vessel heading.

23 Claims, 8 Drawing Sheets

(56) References Cited

U.S. PATENT DOCUMENTS

| | | | | | |
|---|---|---|---|---|---|
| 3,978,805 | A * | 9/1976 | Thomas | B63B 35/44 | 114/264 |
| 4,015,552 | A * | 4/1977 | Korkut | B63B 35/4413 | 114/265 |
| 4,232,625 | A * | 11/1980 | Goren | B63B 39/03 | 114/264 |
| 2004/0067109 | A1 * | 4/2004 | Pollack | B63B 35/4413 | 405/195.1 |
| 2020/0216150 | A1 * | 7/2020 | Syvertsen | B63B 39/06 | |

FOREIGN PATENT DOCUMENTS

| | | | | |
|---|---|---|---|---|
| WO | WO2015/099093 | | 7/2015 | |
| WO | WO-2015099093 | A1 * | 7/2015 | B63B 39/06 |
| WO | WO2017/186284 | | 11/2017 | |

* cited by examiner

OFFSHORE VESSEL FOR PRODUCTION AND STORAGE OF HYDROCARBON PRODUCTS

TECHNICAL FIELD

The present invention generally relates to offshore vessels used for the production and/or storage of petroleum products. More specifically, the present invention relates to offshore vessels for connection of a plurality of submarine risers and a deck structure to support topside modules, such as a Floating Production Storage and Offloading vessel (FPSO) or a Floating Liquefied Natural Gas vessel (FLNG). The hull of the vessels may also be used as a base for a drilling ship.

BACKGROUND AND PRIOR ART

A Floating Production Storage and Offloading (FPSO) system is a floating facility above or close to an offshore oil and/or gas field to receive, process, store and export hydrocarbons.

The system consists of a floater, which may either be a purpose-built vessel or a converted tanker, moored at a selected site. The cargo capacity of the vessel is used as buffer storage for the produced oil. The process facilities (topsides) and accommodations are installed on the floater. The mooring configuration in FPSOs may be of a spread mooring type or a single point mooring (SPM) system such as a turret. A mooring configuration based on Dynamin Positioning (DP) is also possible, but not recommendable due to high complexity and cost.

The high-pressure mixture of produced fluids from the well is delivered to the process facilities on the deck of the vessel in which oil, gas and water are separated. The water may be reinjected in the reservoir or discharged overboard after treatment eliminating hydrocarbons. The stabilized crude oil is stored in the cargo tanks of the vessel and subsequently transferred to trading tankers, either directly, via a buoy, by laying side by side/in tandem to the FPSO vessel or by use of shuttle tankers/cargo transfer vessels (CTV).

The gas may be used for enhancing the liquid production through gas lift and/or for energy production onboard the vessel. The surplus of gas may be compressed and transported by pipeline or reinjected into the reservoir.

A Floating Liquefied Natural Gas vessel (FLNG) is conceptually similar to the FPSO. The difference being that the hydrocarbon mixture from the well is predominantly gas and that the process facility's purpose is to separate, clean and liquefy the gas for storage in dedicated cryogenic tanks within the hull. Offloading of the liquefied gas is done towards trading gas (LNG) vessels.

Conventional ship shaped FPSOs require weather vaning facilities such as a turret when located in harsh environmental areas. A characteristic for these types of FPSOs is however a very different pitch and roll behavior, allowing large waves in head sea conditions, but significantly smaller waves from beam and quartering seas. Weather vaning is hence needed for these type of ships.

Semi-submersible designs may provide favorable and uniform motions. The storage capacity is however limited, and the sensitivity with respect to topside weight is critical. A semi-submersible design is hence not considered advantageous when large storage capacity is an important design criteria as for an FPSO or FLNG unit. Further, structural details are more complex on semi-submersibles, resulting in higher steel-weight per ton topside payload, as well as higher fabrication cost. An early example of a semi-submersible platform is disclosed in WO 02/090177 A1.

Other designs such as box shaped units or cylindrical hulls may provide uniform motional behavior independent of wave direction. If equipped with motion suppressing elements favorable motions may also be achieved. The shape of such units does however not allow use of standard ship-shaped construction facilities. Automatic panel line facilities can not be used without significant modifications, and the shape/dimension gives further limitations. The critical measurements in this respect are breadth and depth. For use of cylindric designs having storage capacity greater than 1,000,000 bbl there will be significant limitation with respect to available dry docks and floating cranes. Another disadvantage of the cylindric design is the low deck-area-to-storage-volume ratio and maximum obtainable distance from safe to hazardous side which complicates the topside design. (1 bbl (oil barrel) is a unit of volume corresponding to 159 liters).

US 2004/0067109 A1 discloses a drilling vessel without storage capability having an elongated shape, preferably of rectangular shape, and moored to the sea bed in a substantially fixed orientation. The vessel comprises two transverse skirts near its keel level having such a width that the natural roll period of the vessel is above a predetermined period. US 2004/0067109 A1 states that length-to-width ratio of the vessel should be at least 1.5, preferably at least 2, since a length-to-width ratio of 1.5 or less may be subject to roll instability or Mathieu instability. The objective of the design of this prior art vessel is to control roll, hence not the combination of heave, roll and pitch. Similar elongated vessels without a pronounced bow and having length-to-breadth-ratios greater than 1.5 are disclosed in patent publications US 2011/0209655 A1, U.S. Pat. No. 4,015,552 and US 2002/0083877.

WO 2015/038003 A1 discloses a platform comprising a hull with a main portion which is substantially axis-symmetrical about a center axis, without a pronounced bow and parallel mid-ship. The upper end of the platform is supporting a deck and the lower end of the platform, situated below a nominal water line, is provided with a non-circular stabilizing element which protrudes from the main portion.

WO 2012/104308 A1 discloses a cylindrical platform for production and storage of hydrocarbons. The substantially circular hull of the vessel is configured to allow suspension of risers on at least one frame arranged in a moonpool in the center of the hull. The frame is placed so that connection of risers may be performed above the water-line when the platform has its minimum draft. The moonpool may comprise a conical form at its lower end allowing static and dynamic angular deflections of the risers. The moonpool extends above the main deck wherein the extended vertical moonpool is narrowed down for increasing the space availability on the deck. The hull may further be equipped with a protrusion to reduce heave, pitch and roll motion.

WO 2014/167591 A1 discloses a drillship with a pronounced bow and parallel mid-ship, where its heave and pitch behavior has been improved by the addition of a protuberance having a flattened shape, either at the bow or at the stern. Due to the lack of roll damping devices this vessel will experience significant roll motions if exposed to waves from abreast. Further, no turrets are disclosed in WO 2014/167591 A1. It is hence assumed that the ship's positioning system is based on a DP system since a spread mooring system would not be able to sufficiently suppress the wave induced motions.

The above mentioned prior arts do not disclose vessels having a design that enables safe, easy and effective handling in harsh environment at the level offered by the FPSO of the present invention.

Consequently, the object of the present invention is to provide a vessel for production and/or storing of hydrocarbons arranged to float in a body of water, hereinafter abbreviated FPSO, offering beneficial properties concerning motional behavior, storage capacity and safety, relative to prior art FPSOs. The application is equally relevant for similar purpose vessels such as FSO or FLNG, but only the term FPSO is used in the following for simplicity.

A second object of the invention is to provide a vessel of non-cylindric design that has motional behavior that is independent of wave direction relative to vessel orientation. Heave, pitch and roll motions shall be favorable and uniform regardless of position on the vessel.

A third object of the invention is to provide an FPSO which is spread moored and does not require a turret, or equipment similar to a turret.

A fourth object of the invention is to provide an FPSO in which the number and/or dimension of mooring lines are less than the number and/or dimension used on conventional spread moored FPSOs of comparable storage capacity.

A fifth object of the invention is to provide an FPSO having a bow design that optimizes the orientation at the field, both with respect to green sea protection and with respect to mooring through reduced drag/wave forces on the hull.

A sixth object of the invention is to provide an FPSO design that is suitable both in benign and harsh environmental conditions.

A seventh object of the invention is to provide an FPSO that is scalable in size with respect to its oil storage capacity.

An eighth object of the invention is to provide an FPSO having a vessel design that enables a higher topside weight capacity compared to conventional FPSO designs.

A ninth object of the invention is to provide an FPSO having a vessel design that ensures a large deck area for placing topside modules and a simple interface, compared to rotational symmetric FPSO designs.

A tenth object of the invention is to provide an FPSO having a design and size such that fabrication can be carried out using standard ship building facilities including existing dry docks, thereby allowing flexibility in choice of fabrication yard.

An eleventh object of the invention is to provide an FPSO having favourable and uniform vertical motions, thereby allowing riser hang-off at any longitudinal and transverse positions.

A twelfth object of the invention is to provide an FPSO having a design that through adjustment of its suppressing element/bilge box allows for use of free hanging steel catenary risers (SCRs) in harsh environment for large water depths, for example between 1,500 meters and 3,000 meters. SCRs may also be applied for more shallow water in case of more benign environmental conditions.

A thirteenth object of the invention is to provide an FPSO design with significantly reduced fatigue compared to conventional ship shaped FPSOs.

In addition to fulfilling one or more of the above-mentioned objects, the particular vessel design of the FPSO should preferably comply with international regulations including class society, MARPOL (International convention for the prevention of pollution from ships), SOLAS (international convention for the safety of life at sea) and/or relevant site specific shelf state requirements. Further, the inventive FPSO should preferably fall within the rule regime associated with conventional ship-shaped vessels.

SUMMARY OF THE INVENTION

The above-mentioned objects are obtained by the invention as set forth and characterized in the main claims, while the dependent claims describe further embodiments of the invention.

In particular, the present invention relates to a spread moored vessel suitable for production and/or storage of hydrocarbons. The vessel comprises a laterally extending main deck, a mooring arrangement suitable for mooring the vessel to a seabed when the vessel is floating in water, and a longitudinal hull. The mooring arrangement is preferably arranged symmetrically relative to the main deck, i.e. mirroring at least one central plane of the hull directed perpendicular to the main deck. The longitudinal hull further comprises a bow, a midbody, a stern and at least one motion suppressing element protruding out from the longitudinal hull, below the vessel's maximum draught, preferably from each of the hull sections. The motion suppressing element(s) causes a significant reduction of undesired motion of the vessel, especially heave, pitch and roll. The ratio between a maximum length and a maximum breadth of the longitudinal hull, at the vessel's maximum draught, is between 1.1 and 1.7, more preferably between 1.1 and 1.7, even more preferably between 1.2 and 1.4. The particular ratios, in combination with the motion suppressing element(s), have the advantage that the effect the waves has on the movements on the vessel relative to longer vessels is reduced, thereby making the vessel more stable during operation. The longitudinal hull as seen from above may have a shape of a rectangle with a rounded triangle at the forward end.

As a consequence of the above features, the vessel motion will be almost independent of wave direction and the requirement of mooring systems other than a spread mooring system may be eliminated. Further, the total number of mooring lines may be reduced as compared to conventional ship shaped spread moored FPSOs, thus reducing complexity and cost for the vessel's mooring arrangement compared to prior art vessels having the same or similar function. It should be noted that spread moored arrangement can only be applied to conventional FPSO designs for areas with relatively benign wave climate.

The term 'laterally extending main deck' signifies a deck having a surface that extends parallel to the water surface when the vessel is floating in a body of motionless water. Further, the hull is hereinafter defined as the area of the longitudinal vessel situated below the main deck area of the vessel.

In an advantageous example the motion suppressing element(s) protrude(s) laterally from the hull along at least 70% of the hull's lateral extending circumference, more preferably at least 80%, for example along the entire circumference.

In another advantageous example the motion suppressing element(s) protrude(s) laterally from a lowermost part of the hull. The lowermost part may be flat, i.e. parallel to the deck.

In yet another advantageous example, the lateral protrusion length of the motion suppressing element(s) is between 5% and 30% of the hull's maximum breadth at the vessel's maximum draught.

In yet another advantageous example, the midbody comprises a port side portion and a starboard side portion, where at least 30% of the longitudinal length of the midbody are flat, i.e. without kinks and/or curves, and oriented parallel to a center plane of the hull. The center plane is hereinafter defined as the plane intersecting the hull midway between midbody, i.e. midway between the port and starboard side portions, and aligned perpendicular to the laterally extending main deck.

In yet another advantageous example, the transition region between the bow and the midbody forms abrupt change of angle at the vessel's maximum draught, relative to the tangent plane of the midbody directed parallel to the center plane, preferably at least 20 degrees.

In yet another advantageous example, the longitudinal length of the bow at the vessel's maximum draught is at least 25% of the maximum length of the hull.

In yet another advantageous example, the mooring arrangement comprising a plurality of mooring lines, wherein at least one mooring line is moorable from a location at or near the center of the bow relative to the hull's breadth, at least one mooring line is moorable from a location adjacent the stern at the port hull side and at least one mooring line is moorable from a location adjacent the stern at the starboard hull side. However, in this particular embodiment additional mooring lines may be arranged at other locations around the lateral periphery of the hull in order to obtain the required positioning/stability. At the locations of the plurality of mooring lines the at least one motion suppressing element has preferably a suitable recess, or is omitted totally, for allowing the mooring lines to be guided into the body of water closer to the lateral center of the vessel. These recesses may also provide additional control of the vessel's motion.

In yet another advantageous example, the longitudinal length of the vessel is separated into a cargo zone and at least one non-cargo zone, for example by a wall and/or a safety distance. Further, the longitudinal hull displays at least one cargo tank for containing cargo, wherein the cargo tank, or all cargo tanks in case of a plurality of cargo tanks, are confined within the cargo zone of the vessel. No cargo tanks are thus located outside the cargo zone. The non-cargo zone is preferably situated at the bow of the vessel. However, such a non-cargo zone may also be situated at the stern for specific topside layouts. Further, the hull may be double side around its circumference of the vessel, having one or more ballast tanks in between the hull walls.

In yet another advantageous example, the longitudinal hull further displays at least one slop tank situated adjacent to the at least one cargo tank, for collecting drainings, tank washings and other fluid mixtures. The at least one slop tank is preferably arranged in or adjacent to the center plane of the hull.

In yet another advantageous example, at least one of the at least one non-cargo zone is located within the bow.

In yet another advantageous example, the longitudinal hull comprises at least two walls having a space therebetween, into which at least one ballast tank is located.

In yet another advantageous example, the vessel is configured to allow hang off of a multiple riser arrangement at the midbody, the bow and/or the stern.

In yet another advantageous example, a plurality of riser guide pipes is arranged along at least part of the lateral circumference of the longitudinal hull. Each of the plurality of riser guide pipes is configured to allow at least one riser to be guided therethrough.

In yet another advantageous example, the projected lateral surface area of the hull at the vertical position of the main deck is larger than the projected lateral surface area of the hull at the vertical position of the vessel's maximum draught, preferably at least 10% larger, for example 20% larger. The onset of the increase preferably commences at or above the vessel's maximum draught. The full increase from the onset may take place abruptly. However, it is preferable that the increase is continuous, for example a linear increase with a ratio of 1:2, or a comparable parabolic increase. Such a vessel design increases the deck area available for placing topside modules, while enabling a simple interface. This, in combination with a stern and a midbody of rectangular shape forms a large available space for topside modules on the deck compared to conventional ship shaped FPSOs.

In yet another advantageous example, the ratio between the maximum length of the longitudinal hull and a maximum depth of the longitudinal hull, where the maximum depth is defined as a distance from the vertical position of the main deck to the lowermost part of the hull, is between 2 and 6, more preferably between around 2 and around 3. These ratios are considerably smaller than conventional ship shaped FPSOs, typically between 10 and 12. The small length to depth ratio of the inventive FPSO will result in significantly reduced hull girder bending stress and/or deflection compared to conventional ship shaped FPSOs, resulting in a simplified topside interface without need for sliding supports. Considering that the hull girder bending moment is proportional to the length squared ($L_{wl}^2$), and the capacity is a function of the depth squared ($D_{wl}^2$), it is clear that a reduction in $L_{wl}/D_{wl}$ causes a corresponding reduction in hull girder stress. The comparison may also be illustrated in terms of longitudinal hull girder stress at main deck level. Whereas the conventional ship-shaped FPSO designs experience about 75% of material yield in the deck plating, the inventive design will see less than 25% of material yield.

In yet another advantageous example the hull of the vessel is dimensioned in size/shape and with tank arrangement such that the hull may support a total weight above the main deck that is larger than the total weight of the hull including main deck.

Static loads dominate the load picture for the inventive FPSO design, meaning that fatigue in general is not governing. Hence, the number of critical details will be significantly less with the above mentioned inventive vessel relative to conventional ship shaped FPSO designs.

The governing static loading of the FSO/FPSO design also allows use of manufacturing materials such as high tensile steel (typically 355 MPa grade) to a greater extent than for conventional vessel designs with length>>breadth, giving not only lower weight (due to inter alia use of thinner plates), but may also result in lower cost since material such as high tensile steel has lower strength/cost ratio compared to normal strength steel.

The combination of reduced motion, large deck area, large topside load capacity and a large storage volume are all important characteristics for FPSOs, storage vessels and units for floating production, cooling and storage of natural gas (FLNG). The combination of a longitudinal vessel with ($L_{wl}/B_{wl}$) ratio of less than 1.7, preferably equal or less than 1.5, and with motion suppressing element(s) protruding from the hull have positive contributions to these characteristics.

As explained above, the particular design of the hull of the vessel also enables the use of SCR risers. This is a great advantage over use of traditional flexible risers since the latter solution is in general more expensive, gives a more complex installation and requires more maintenance compared to a solution with steel risers. Furthermore, flexible risers are more sensitive to irregularities during operation and have a shorter lifetime than steel risers. Since repair of a flexible riser has proved difficult, they are often exchanged with new ones, thereby increasing cost further. SCRs may be hung of at side, at the stern or through a moonpool within the hull.

Due to the vessel design with a bow, parallel midbody and a stern which are familiar characteristics for shipyards, the inventive vessel provides flexibility with respect to fabrication yard and fabrication method.

The inclusion of a pronounced bow on the vessel results in several advantages compared to prior art box and cylindrical shaped vessels:

For a given size of vessel in terms of storage capacity the bow shape gives a greater overall length than without the bow and by that allows for greater distance between safe area and hazardous area on the vessel. The bow shape also provides an area outside the cargo area for location of the living quarter ensuring that the living quarter is not located above cargo tanks, which again provides full flexibility in filling of cargo tanks without jeopardizing the safety or damage stability of the vessel.

With the added bow the vessel may be oriented such that drag/wave forces on the hull are reduced. Aligning the vessel with the bow against the direction from which the maximum waves are coming will give reduced drag forces on the vessel and consequently allow for optimization of the mooring system. The curved small radius bow shape also has larger structural capacity than a flat or semi-flat structure and enables adequate strength at a lower steel weight. Resistance during potential wet tow will also be reduced compared to a design without a bow which in turn will increase towing speed and reduce towing cost.

In the following description, numerous specific details are introduced to provide a thorough understanding of embodiments of the claimed longitudinal vessel. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

BRIEF DESCRIPTION OF THE DRAWINGS

The invention will now be described with reference to the attached drawings, wherein.

DETAILED DESCRIPTION OF THE INVENTION

Figure 1:
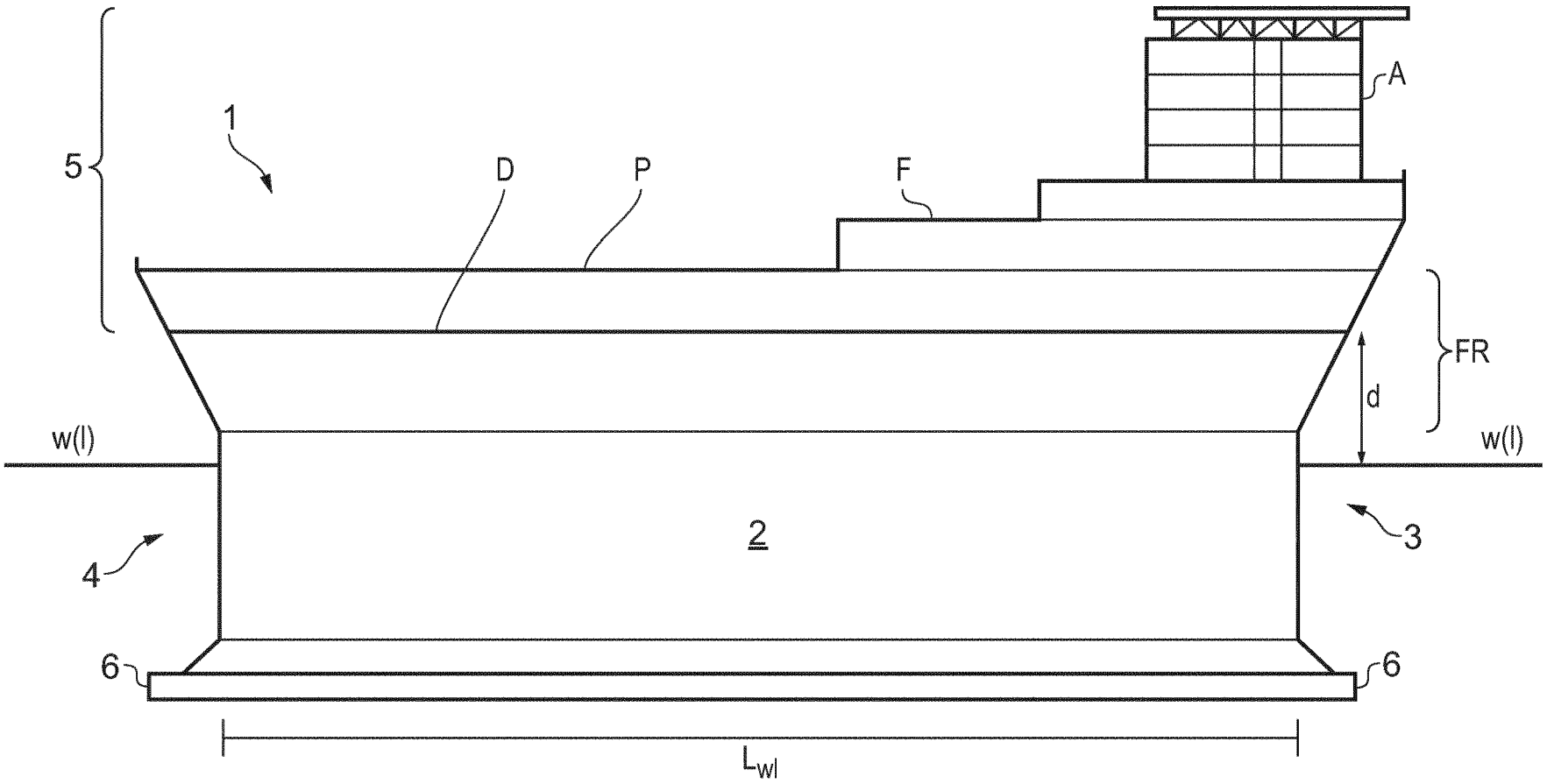
FIG. 1 is a side view of a vessel according to an embodiment of the present invention.
Figure 2:
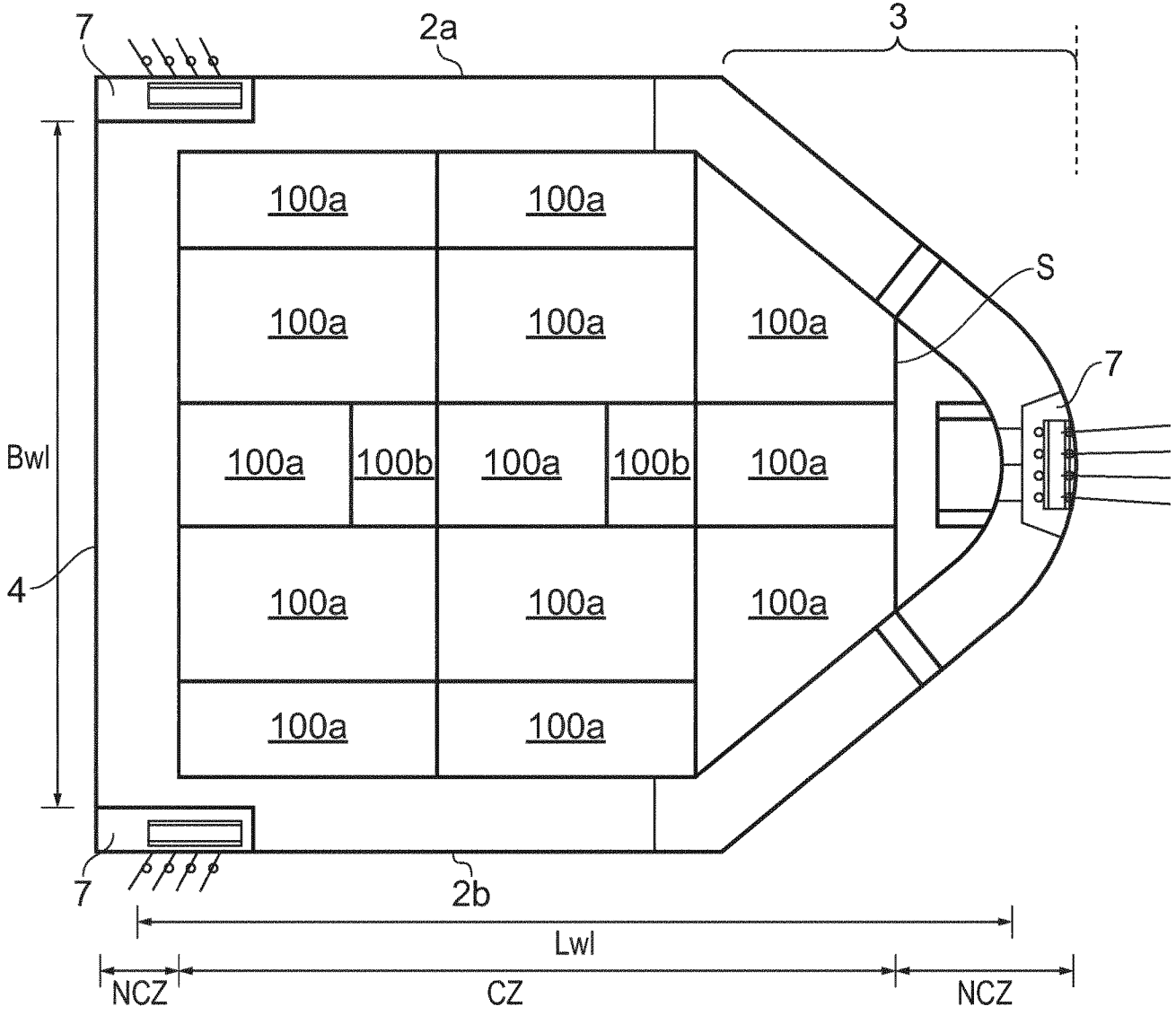
FIG. 2 is a top view of the vessel according to FIG. 1 showing the elevated deck and exemplary positions of cargo tanks, slop tanks and mooring winch arrangement.
Figure 3:
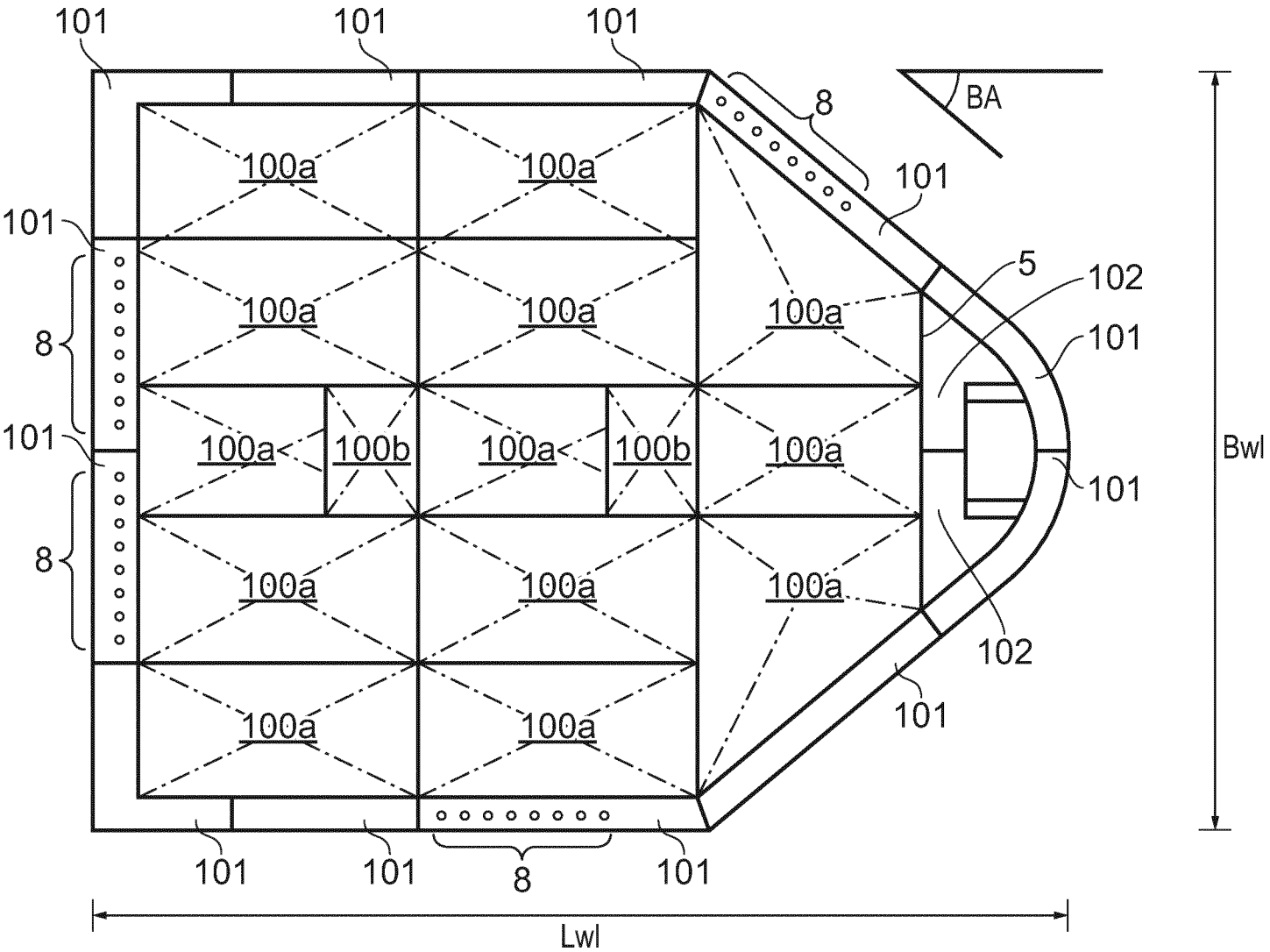
FIG. 3 shows a horizontal section through a vessel according to FIGS. 1 and 2, showing exemplary locations of cargo tanks, slop tanks, fuel-tanks and ballast tanks, the horizontal section being in or around the waterline, i.e. between the hull's suppressing elements and the hull's flared side shell.
Figure 4:
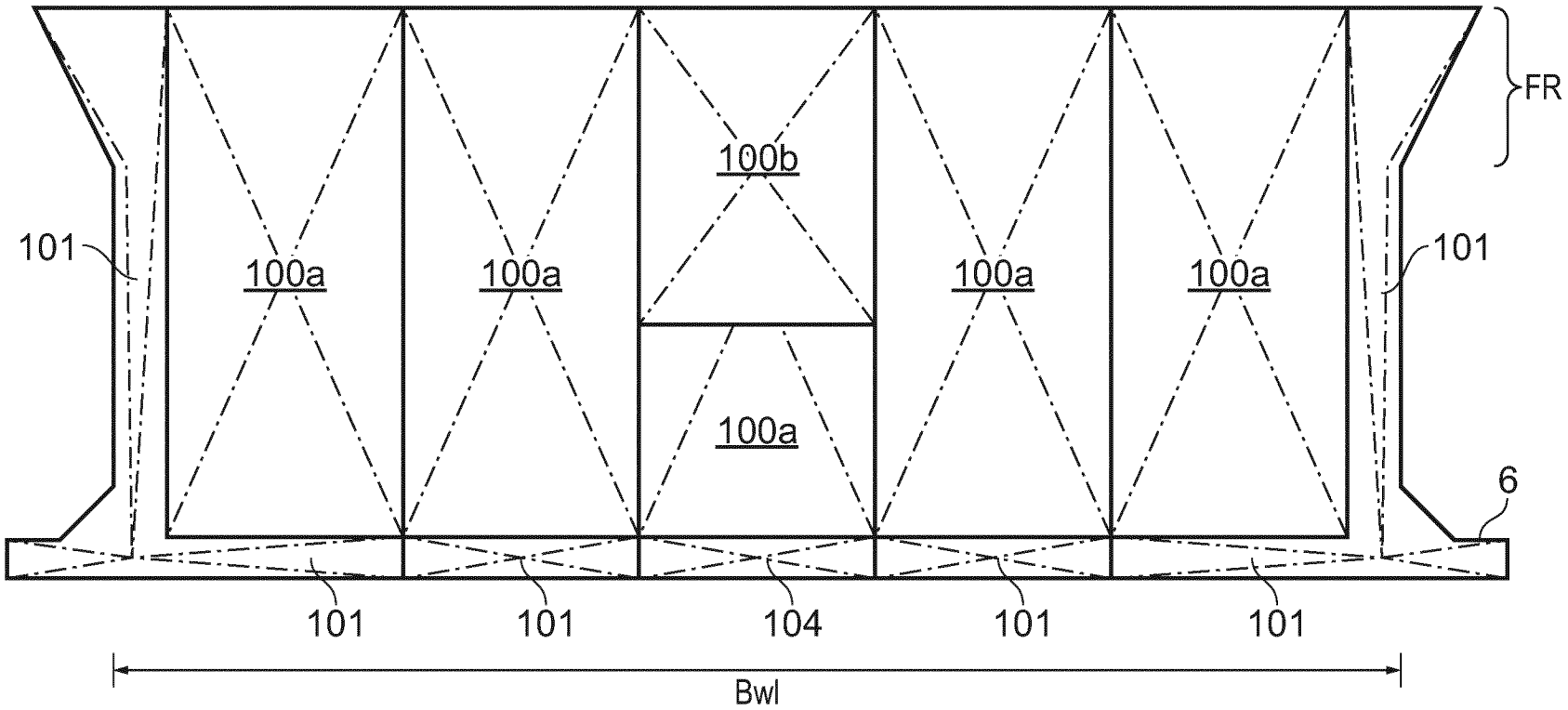
FIG. 4 shows a transverse cross section through the cargo zone of the vessel according to FIGS. 1-3.

FIGS. 1-7 show a first embodiment of a longitudinal vessel 1 according to the present invention having a maximum length and breadth at the location of the vessel's maximum draught of $L_{wl}$ and $B_{wl}$, respectively (see in particular FIG. 2). The vessel 1 comprises a bow 3, a stern 4, a hull 2 with a parallel midship 2*a*,2*b* and a deck structure 5. The latter further comprises a main deck D, a processing deck P, and living quarters A supported on a fore deck F. Below the vessel's 1 maximum draught or waterline (w(l)), the hull 2 is provided with a suppressing element or damping extrusions 6 protruding outwards from the hull 2, preferably around the entire periphery of the hull 2. The suppressing element 6 may extend 10-25% of the vessel 6 breadth, depending on required motion characteristics. The safe area of the FPSO, i.e. the area of the main deck D containing the living quarters A, is segregated from the processing area either by distance or by a blast wall. The area of the bow 3 and/or the area of the stern 4 may be raised to provide improved protection with respect to green sea. Further, as is more apparent in FIG. 2, the deck area behind the area of the bow 3 is preferably rectangular, thereby enabling simple and effective arrangement of topside modules. The maximum length of the vessel 1 ($L_{wl}$) is preferably within 1.1 to 1.5 times the maximum breadth of the vessel 1 ($B_{wl}$), for example 1.3 times the breadth ($B_{wl}$). As best seen in FIGS. 1 and 4, the upper side of the hull 2, that is the height of the hull 2 situated above the water line (w(l)) or maximum draught, is flared out to provide a larger deck area.

The flared region FR typically starts about 1 meter above waterline (w(l)), and extends to the process deck P or above depending on the required deck space. The standard flare angle of the flared region is typically 1:2 in terms of horizontal versus vertical increment, but may be increased for areas in which wave slamming is not an issue. The flare angle may thus be varied around the circumference of the vessel 1.

The main deck elevation D in relation to the waterline w(l) is determined for each specific application, but is as a rule kept as low as possible within the limits given by international load line convention, stability and green sea. A distance (d) of the main deck elevation D of about 10-12 meters above the waterline w(l) is typical for harsh environment areas, and somewhat less in case of benign conditions. The process deck P is typically located 4-6 meters above the main deck D. For very severe wave conditions, the fore deck F, at which the living quarter and lifeboats will be located, may be raised another 4-6 meters.

The suppressing element 6 provides additional added mass that inter alia influences heave, pitch and roll motions of the vessel 1 caused by external forces such as waves. By tuning the size of the suppressing element, the vessel shape, including length to breadth ratio and waterline area, and the total mass of the vessel including added mass, it is thus possible to achieve a natural frequency outside the range of the critical wave excitation frequency. In selecting the actual shape and design of the vessel, coupling effects between inertia, damping and buoyancy forces need to be considered as these effects have significant influence on the heave, roll and pitch motions. It is the combination of the increased natural period and the mentioned coupling effects that gives the favorable motion characteristics of the present invention. This motion behavior has been documented and verified through calculations and model testing.

FIGS. 2 and 3 show top view sections at the main deck D and the waterline w(l), respectively and give an overview of the tank arrangement of the vessel. The vessel 1 is divided into

- non-cargo zones (NCZ) comprising a plurality of ballast tanks 101 and fuel/MDO (marine diesel oil) tanks 102 and
- a cargo zones (CZ) comprising a plurality of cargo tanks 100*a* and appurtenant slop tanks 100*b*.

The double hull configuration with flared outer hull 2 gives a significant area around the circumference of the main deck D in which there are no hydrocarbon content underneath. With a double side of 3-4 meters, and the mentioned hull 2 with the flared region FR, the width of the outer deck area above ballast tanks will be more than 8 meters. FIGS. 2 and 3 also show the distinctive rectangular shape of the aft part 4 and midbody part 2*a*,2*b*, as well as the triangular bow 3 including curved forward part (the latter being in FIG. 3 confined within the safety area, that is, forward the safety division S).

Figure 7:
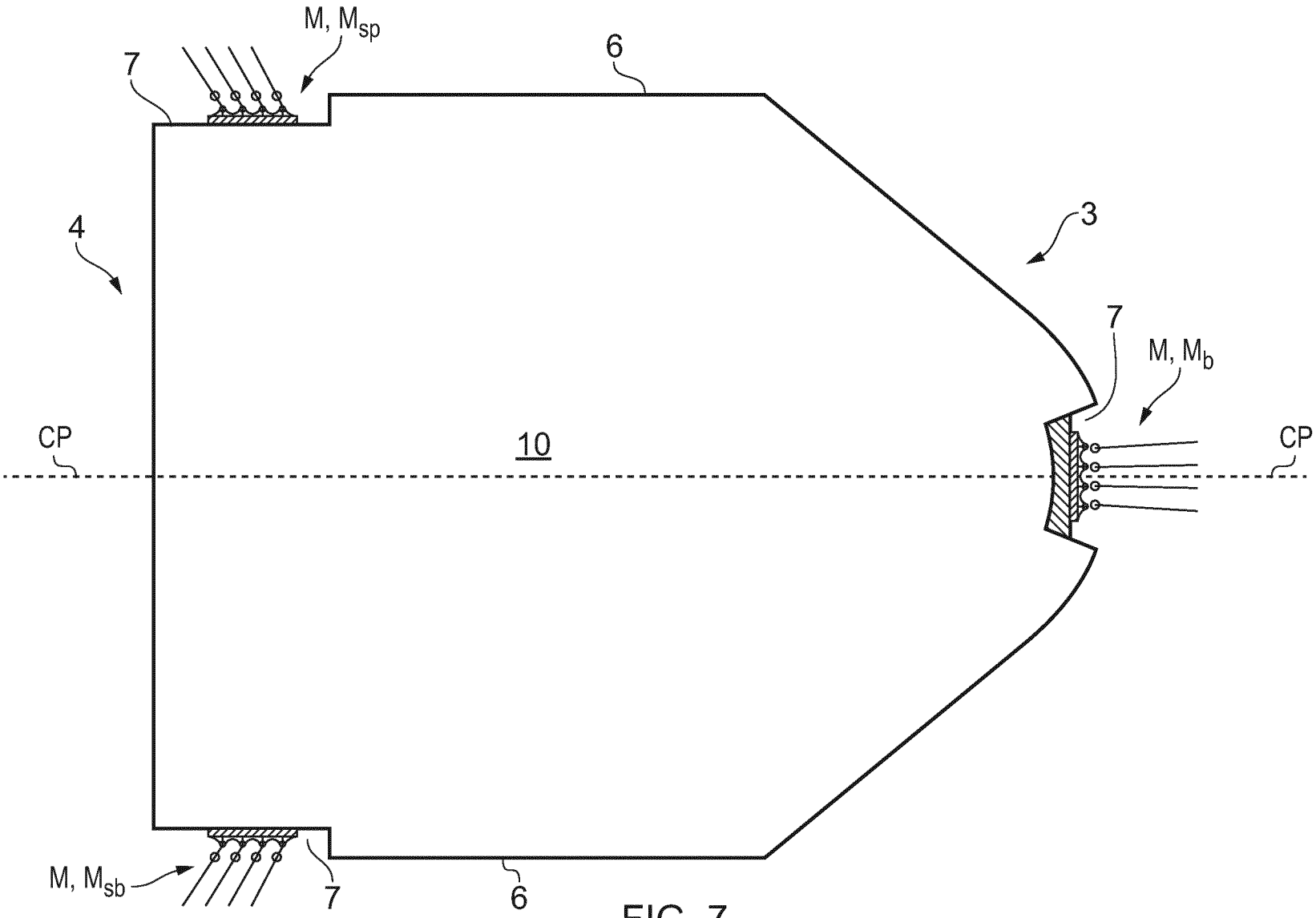
FIG. 7 is a view of the bottom of the vessel according to the invention, including mooring lines and local recesses in the suppressing elements, FIGS. 8 (*a*) to (*d*) show representative motion characteristics of a vessel according to the invention as compared to conventional ship-shaped designs of comparable storage capacity by plotting simulated response of the heave motion as function of the wave period for the inventive FPSO (a) and a conventional FPSO (b) and by plotting simulated data of the ration pitch/roll motion as function of the wave period for the inventive FPSO (c) and the conventional FPSO (d).

The midbody of the hull 2 comprises a port side portion 2*a* and a starboard side portion 2*b* oriented parallel to a center plane CP of the hull 2, the center plane CP being defined as the plane intersecting the hull 2 midway between the port side portion 2*a* and the starboard side portion 2*b* and aligned perpendicular to the main deck D (see stippled line in FIG. 7).

The wave excitation forces are greatest in the waterline area, and hence the vessels 1 shape and dimensions in this area are decisive in achieving the favorable and wave-direction-independent responses. The bow part 3 shown in FIGS. 2 and 3 constitutes about 35% of the length in waterline w(l), that is, 35% of $L_{wl}$, and forms a bow angle (BA) between 20 and 60 degrees from the parallel midship. With a bow angle of 40 degrees, and with a length to width ratio ($L_{wl}/B_{wl}$) in waterline w(l) of about 1.3, the length and breadth range of the inventive design will be $L_{wl}$=50-140 meters and $B_{wl}$=35-100 meters for storage capacities from 100,000 bbls–2,000,000 bbls, as an example only.

As an alternative, the distribution of pump rooms 103 and fuel tanks 102 may be located in the aft part 4 of the vessel 1.

Figure 5:
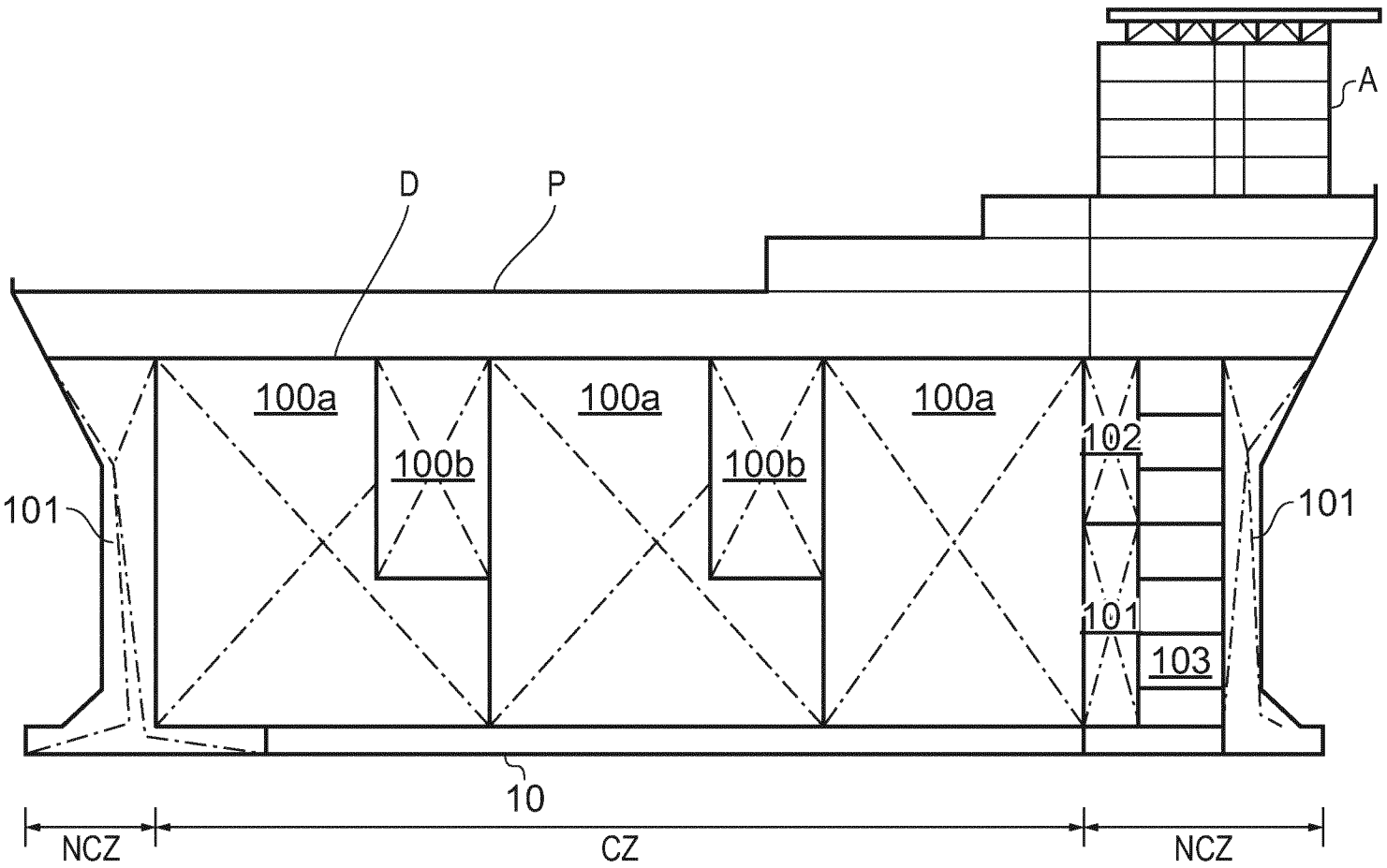
FIG. 5 is a longitudinal cross-section through a center plane of the vessel according to FIGS. 1-4.
Figure 6:
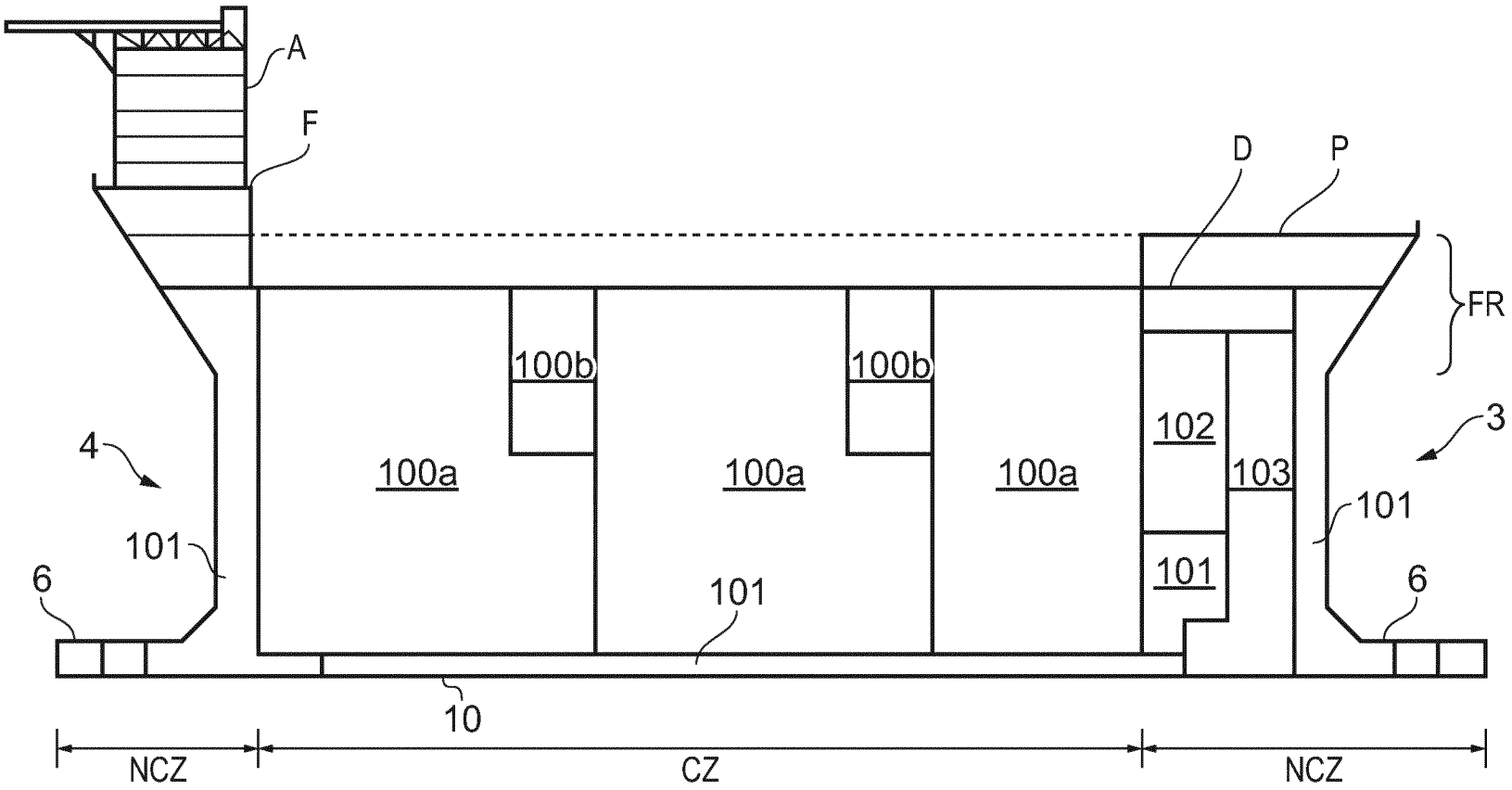
FIG. 6 is a longitudinal cross-section through a center plane of a vessel according to a second embodiment of the invention showing an alternative configuration where a safe area with living quarters are located towards the stern of the vessel.

The arrangement of ballast tanks 101 around the circumference of the hull 2 provide protection of the ballast and slop tanks 100*a*,100*b*, the fuel tanks 102 and the pump room 103. A double bottom 10 as shown in FIGS. 4-6 provides further protection to the tanks 100*a*,100*b*,102,103, as well as being used as space for additional ballast tank(s) 101. This tank arrangement, combined with the wide breadth of the vessel 1, results in high vessel stability. High stability allows for applying large process apparatus/systems on vessel 1 such as FPSOs or FLNGs. If using the vessel 1 for natural gas, the ballast and slop tanks should be separated from tanks for fluid cooled natural gas.

An example of a mooring arrangement M is shown in FIGS. 2 and 7. The mooring arrangement M comprises a plurality of mooring lines arranged at the fore Mb and on aft corners $M_{sp}$ (port), $M_{sb}$ (starboard) of the vessel 1 such that the entire mooring arrangement M mirrors the central longitudinal plane CP of the vessel 1. Such a spread mooring arrangement M ensures a fixed, non-rotatable vessel-position during hydrocarbon production, thereby avoiding the need for costly and complex turret assemblies and/or dynamic positioning systems (DP). In the particular example shown in FIGS. 2 and 7, the mooring lines are distributed within three symmetrically arranged recesses 7 carved into the circumventing suppressing element 6.

FIG. 4 shows a cross section of the hull 2 in a plane oriented along the vessel's breadth and within the vessel's 1 midship. The particular view visualizes the example tank arrangement including five cargo tanks 100*a* abreast, protected by double side ballast tanks 101 and a double bottom. A slop tank 100*b* is illustrated above the mid cargo tank 100*a*. The double bottom may be used for confining both ballast tanks 101 and void tank(s) 104 as illustrated in FIG. 4. The required slop capacity is typically 3% of the cargo carrying capacity. Hence, the slop tanks 100*b* are small compared to the cargo tanks 100*a*. For venting, access and operational purposes it is beneficiary to have access to the slop tanks 100*b* from main deck D. The slop tanks 100*b* are therefore typically located towards deck within the volume of the center cargo tanks 100*a*.

FIG. 5 shows a section view through the longitudinally directed center plane CP of the vessel 1, illustrating the non-cargo zones and the cargo zone, as well as the tank distribution, in the vessel's 1 longitudinal direction. The figure also clearly shows that the living quarter A is not located above any cargo or slop tanks 100*a*,100*b*.

FIG. 6 shows a sectional view through the longitudinally directed center plane CP of a second embodiment of the inventive vessel 1. In this embodiment the living quarter A is located at the stern 4 of the vessel 1, an embodiment that may be preferable in case the prevailing wind direction is opposite the direction of maximum wave height to which the bow 3 is facing. From a safety point of view, it is generally a preference to have the living quarter A upwind from the processing plant and flare region FR. FIG. 6 also shows a design in which the suppressing element 6 at the keel is extended compared to the embodiment shown in FIGS. 1-5 to further increase the natural period and dampen the motions. As for FIG. 5, the locations of the non-cargo zones and the cargo zone is illustrated in the vessel's 1 longitudinal direction.

With the above-mentioned design, and within the constrains of an existing/standard yard- and construction facility, the inventive FPSO may obtain a storage capacity in excess of 2,000,000 bbls.

Figure 8:
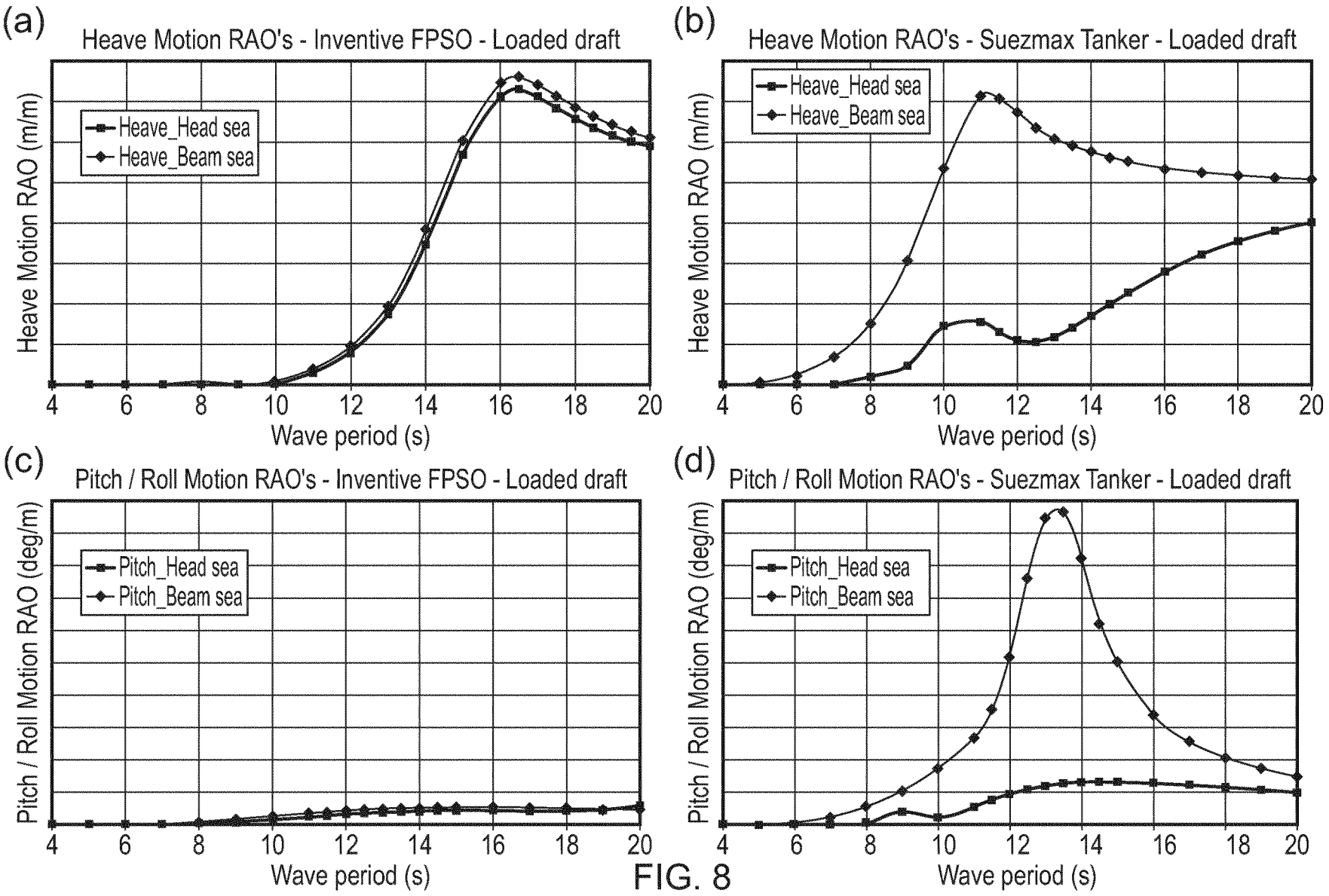

FIGS. 8 *a*) and *c*) shows calculated heave RAO's (Response Amplitude Operator) and roll and pitch RAO's for the present invention, respectively, while FIGS. 8 *b*) and *d*) show the corresponding calculated RAO's for a conventional ship-shaped FPSO design. The axis scale is the same for the two concepts to enable direct comparison. As seen in FIGS. 8 *a*) and *c*) the motion behavior in beam and head see is practically uniform for the present invention, as compared to the ship-shaped design in FIGS. 8 *b*) and *d*). A comparison between FIG. 8 *a*) and FIG. 8 *b*) also shows that the natural period in heave is significantly higher for the present invention (about 16.6 s) then for the conventional ship (about 11 s). Further, it is apparent from these figures that there will be close to no response for wave periods less than 10 seconds for the inventive vessel, while the conventional ship-shaped design will experience heave motion at waves starting from 5 seconds.

As clearly seen by comparing FIG. 8 *c*) with FIG. 8 *d*), the difference is even greater when it comes to roll and pitch motions. At an example wave period of 12 seconds the conventional ship-shaped vessel will experience pitch angles in head seas that are more than 3 times those seen for the inventive vessel and roll angles in beam seas of more than 10 times that of the inventive vessel.

The presented calculations are for a Suezmax tanker of about 1,000,000 bbl storage capacity, where 1 bbl equals about 159 litres. The following input values have been used in the calculations:

| Hull dimension | Inventive vessel | Typical conventional tanker |
|---|---|---|
| Length, Lwl [m] | 93 | 250 |
| Breadth, Bwl [m] | 68 | 45 |
| Draught [m] | 26.5 | 16 |
| Displacement [ton] | 155,000 | 155,000 |
| Extension of surpressing element (bilge box) [m] | 6 | — |

The calculations of the RAO curves are made for motion responses in regular waves using potential theory, including corrections for viscous forces using Morison elements. Computer program used for the analyses is WADAM from DNV-GL. Calculations for larger and smaller size vessels show the same behavioral pattern.

For the inventive vessel 1, the pitch and roll motions (FIG. 8 (*c*)) are very small compared to the heave motions (FIG. 8 (*a*)). Hence, the vertical motion at any given point will be governed by heave motions. This gives a vessel 1 with almost uniform vertical motion and acceleration across the length and breadth, regardless of wave heading, which in turn gives flexibility in location and/or orientation of topside equipment and allows riser-hang-off at any position on the vessel 1. That is, riser hang-off forward, at side, aft or along the centerline of the vessel 1. The risers will typically be free hanging, e.g. from the main deck or pulled in through guide pipes 8 in the double side hull and hung off at main deck elevation D. FIG. 3 shows example location of the riser guide tubes 8 arranged at the aft and at the port side of the bow on port side. The number of riser guide tubes 8 shown in the figures is for example only. The present invention may allow use of up to 60 risers if deemed necessary.

In the preceding description, various aspects of the vessel according to the invention have been described with reference to the illustrative embodiment. For purposes of explanation, specific numbers, systems and configurations were set forth in order to provide a thorough understanding of the vessel and its workings. However, this description is not intended to be construed in a limiting sense. Various modifications and variations of the illustrative embodiment, as well as other embodiments of the vessel, which are apparent to persons skilled in the art to which the disclosed subject matter pertains, are deemed to lie within the scope of the present invention.

LIST OF REFERENCE NUMERALS/LETTERS

1 vessel
2 hull
2*a* port side portion
2*b* starboard side portion
3 bow
4 stern
5 deck/deck structure
6 suppressing element/bilge box
7 recess
8 riser guide pipes
9 mooring winch
10 bottom of the hull
100*a* cargo tanks
100*b* slop tanks
101 ballast tanks
102 fuel tank/MDO tank
103 pump room
104 void tank
A living quarters
$L_{wl}$ maximum hull length in waterline
$B_{wl}$ maximum hull breadth in waterline
CP center plane
D main deck
F fore deck
FR flared region from waterline to process deck
BA bow angle
M mooring arrangement
P processing deck
S safety division
w(l) water level of the vessel at its maximum draught

The invention claimed is:

1. A spread moored vessel for production and storage of hydrocarbons, the vessel comprising
- a laterally extending main deck,
- a mooring arrangement for mooring the vessel to a seabed when the vessel is floating in a body of water and
- a longitudinal hull,
  - wherein the ratio between a maximum length and a maximum breadth of the longitudinal hull, at the vessel's maximum draught, is between 1.1 and 1.5 and
  - wherein the longitudinal length of the vessel is separated into a cargo zone comprising at least one cargo tank and at least one non-cargo zone, wherein the longitudinal hull comprises
- a motion suppressing element protruding out from the longitudinal hull, below the vessel's maximum draught, for suppression of heave, pitch and roll,
- a bow having a lateral cross section in the shape of a rounded triangle,
- a midbody and
- a stern,
- wherein the lateral cross section of the midbody and the stern at the vessel's maximum draught has a rectangular shape.

2. The vessel according to claim 1, wherein the ratio between the maximum length and the maximum breadth of the longitudinal hull, at the vessel's maximum draught, is between 1.2 and 1.4.

3. The vessel according to claim 1 or 2, wherein the motion suppressing element protrudes out from the bow, the midbody and the stern, below the vessel's maximum draught.

4. The vessel according to claim 1, wherein the motion suppressing element protrudes laterally from the hull along at least 70% of the hull's lateral extending circumference.

5. The vessel according to claim 1, wherein the motion suppressing element protrudes laterally from a lowermost part of the hull.

6. The vessel according to claim 1, wherein the lateral protrusion length of the motion suppressing element is between 5% and 30% of the hull's maximum breadth at the vessel's maximum draught.

7. The vessel according to claim 1, wherein the midbody comprises a port side portion and a starboard side portion, where at least 30% of the longitudinal length of the midbody are flat and oriented parallel to a center plane of the hull, the center plane being the plane intersecting the hull midway between the port and starboard side portions and aligned perpendicular to the laterally extending main deck.

8. The vessel according to claim 1, wherein the transition region between the bow and the midbody forms abrupt change of angle at the vessel's maximum draught, relative to the center plane, the center plane being the plane intersecting the hull midway between the port and starboard side portions (2*a*, 2*b*) and aligned perpendicular to the laterally extending main deck.

9. The vessel according to claim 8, wherein the angle is at least 20 degrees.

10. The vessel according to claim 1, wherein the longitudinal length of the bow at the vessel's maximum draught is at least 25% of the maximum length of the hull.

11. The vessel according to claim 1, wherein the mooring arrangement comprising a plurality of mooring lines, wherein at least one mooring line is moorable from a location at or near the center of the bow relative to the hull's breadth, at least one mooring line is moorable from a location adjacent the stern at the port hull side and at least one mooring line is moorable from a location adjacent the stern at the starboard hull side.

12. The vessel according to claim 11, wherein the motion suppressing element displays recesses at the lateral locations of the plurality of mooring lines when the vessel is moored to the seabed.

13. The vessel according to claim 1, wherein the longitudinal hull further displays at least one slop tank situated adjacent to the at least one cargo tank.

14. The vessel according to claim 13, wherein the at least one slop tank (100*b*) is arranged in or adjacent to the center plane of the hull, the center plane being the plane intersecting the hull midway between a port side portion and a starboard side portion constituting the midbody and aligned perpendicular to the laterally extending main deck.

15. The vessel according to claim 1, wherein at least one of the at least one non-cargo zone is located within the bow.

16. The vessel according to claim 1, wherein the longitudinal hull comprises at least two walls having a space therebetween, into which at least one ballast tank is located.

17. The vessel according to claim 1, wherein the vessel is configured to allow hang off of a multiple riser arrangement at least one of the midbody, the bow and the stern.

18. The vessel according to claim 1, wherein a plurality of riser guide pipes are arranged along at least part of the lateral circumference of the longitudinal hull, where each of the plurality of riser guide pipes is configured to allow at least one riser to be guided therethrough.

19. The vessel according claim 1, wherein the projected lateral surface area of the hull at the vertical position of the main deck is larger than the projected lateral surface area of the hull at the vertical position of the vessel's maximum draught.

20. The vessel according to claim 1, wherein the projected lateral surface area of the hull at the vertical position of the main deck is at least 10% larger than the projected lateral surface area of the hull at the vertical position of the vessel's maximum draught.

21. The vessel according to claim 19 or 20, wherein the onset of increase of the projected lateral surface area of the hull from the vertical position of the vessel's maximum draught to the vertical position of the main deck commences at or above the vessel's maximum draught.

22. The vessel according to claim 20, wherein the increase of the projected lateral surface area of the hull from the vertical position of the vessel's maximum draught to the vertical position of the main deck is constant.

23. The vessel according to claim 1, wherein the ratio between the maximum length of the longitudinal hull and a maximum depth of the longitudinal hull defined as a distance from the vertical position of the main deck to the lowermost part of the hull is between 2 and 6.

* * * * *